US005709141A

United States Patent [19]

Ohashi et al.

[11] Patent Number: 5,709,141

[45] Date of Patent: Jan. 20, 1998

[54] VARIABLE DISPLACEMENT HYDRAULIC SYSTEM

[75] Inventors: Ryota Ohashi; Shigenori Sakikawa; Shinya Sakakura, all of Amagasaki, Japan

[73] Assignee: Kanzaki Kokyukoki Mfg. Co., Ltd., Japan

[21] Appl. No.: 526,975

[22] Filed: Sep. 12, 1995

Related U.S. Application Data

[62] Division of Ser. No. 294,820, Aug. 26, 1994.

[30] Foreign Application Priority Data

Aug. 26, 1993 [JP] Japan ..... 5-211207

[51] Int. Cl.[6] ..... F01B 3/02

[52] U.S. Cl. ..... 92/12.2; 91/505

[58] Field of Search ..... 74/839; 91/505, 91/506; 92/12.2; 417/222.1; 384/2

[56] References Cited

U.S. PATENT DOCUMENTS

| | | | |
|---|---|---|---|
| 3,747,476 | 7/1973 | Ankeny et al. | 91/506 |
| 3,803,987 | 4/1974 | Knapp | 91/506 |
| 3,991,658 | 11/1976 | Bobier | 91/505 |
| 4,581,980 | 4/1986 | Berthold | 91/506 |
| 4,896,583 | 1/1990 | Lemke | 92/12.2 |
| 4,918,918 | 4/1990 | Miki et al. | 91/505 |
| 5,311,740 | 5/1994 | Shiba et al. | 60/453 |

FOREIGN PATENT DOCUMENTS

| | | | |
|---|---|---|---|
| 61-28062 | 8/1986 | Japan . | |
| 970584 | 9/1964 | United Kingdom | 92/12.2 |

*Primary Examiner*—F. Daniel Lopez

*Attorney, Agent, or Firm*—Sterne, Kessler, Goldstein & Fox P.L.L.C.

[57] ABSTRACT

A variable displacement hydraulic system contains a housing, a cylinder block provided with a plurality of pistons movable in reciprocation, and a swash plate for controlling reciprocation of each of the pistons so that the swash plate is slantwise rotatable along a slidable contact surface of arcuate shape. A thrust metal is mounted to an arcuate contact surface of the housing. Arcuate plates having smooth surfaces of high sliding efficiency are fixed onto outwardly curved portions formed at the rear surface of the swash plate, which is in contact with the thrust metal. Alternatively, a smooth surface layer having a high sliding efficiency is formed on the swash plate by applying chemical processes, thereby reducing the sliding resistance of the swash plate and improving the ease with which the swash plate is restored to the neutral position.

14 Claims, 17 Drawing Sheets

VARIABLE DISPLACEMENT HYDRAULIC SYSTEM

This application is a division of application Ser. No. 08/294,820, filed Aug. 26, 1994.

BACKGROUND OF THE INVENTION

1. Field of the Invention

The present invention relates generally to variable displacement hydraulic systems, and more particularly to a slide unit of a swash plate for a variable displacement hydraulic system.

2. Related Art

Conventionally, slide unit supporting structures of variable displacement hydraulic system swash plates are well-known, as disclosed in, for example, Japanese Utility Model Publication Gazette No. Sho 61-28062. In this reference, a concave surface is formed at the inner surface of a support member housing and a convex or an outwardly curved portion is formed at the rear of the swash plate, so that the convex portion moves along the concave surface to move the swash plate in a slantwise fashion. Since the concave surface of the housing has a high coefficient of fiction, thrust metal coincident with the concave surface is usually fixed thereto and the inner surface of the thrust metal forms a slidable contact surface with respect to the outwardly curved portion. Accordingly, the outwardly curved portion of the swash plate rotates slantwise along the slidable contact surface of the inner surface of thrust metal.

The swash plate, however, is subjected to oil pressure from the hydraulic pistons. When frictional resistance between the rear surface of the swash plate and the thrust metal guide surface increases, the sliding resistance of the swash plate increases, requiring a larger force to be exerted by an operator in order for the swash plate to be moved in a slantwise fashion. In swash plates constructed to be biased by a spring so as to automatically return to the neutral position when the swash plate is stopped, this problem makes operation especially inconvenient, because the swash plate does not return to the neutral position when the frictional resistance overcomes the biasing force of the spring. Also, when the rear surface of the swash plate in contact with the thrust metal is conventionally processed, the frictional resistance is not sufficiently reduced.

SUMMARY OF THE INVENTION

To achieve the foregoing and other objects, and in accordance with the purposes of the present invention, as embodied and broadly described herein, the variable displacement hydraulic system of the present invention is constructed so that the sliding resistance of the swash plate is diminished to reduce the required operating force such that the swash plate quickly returns to the neutral position when the operator releases an operating lever. This can be accomplished by forming a smooth surface layer having a high sliding efficiency on the outwardly curved portion of the swash plate rear surface by chemicals. This may also be accomplished by affixing a plate having a smooth surface, a high sliding efficiency, and a similar shape to that of the swash plate to the swash plate itself, so that the plate and swash plate integrally slide along the thrust metal which is affixed to the concave surface of the housing.

In the case where the plate of similar shape is fixed to the outwardly curved portion of the swash plate, it is preferable to form a recess or a projection at the outwardly curved portion of the swash plate. This allows a peripheral length of the plate of similar shape to be larger than that of the thrust metal. Hence, even when the swash plate is slanted to a maximum, the plate of similar shape can maintain surface contact with the terminus of the thrust metal.

Another method of affixing the plate of similar shape onto the outwardly curved portion of the swash plate is by hooking a bent portion of the end of the plate of similar shape onto an edge of the swash plate terminus. Also, when the swash plate is molded, the plate of similar shape can be cast in the swash plate in order to expose the surface thereof.

These and other objects, features and advantages of the invention will become more apparent upon a reading of the following detailed specification and drawings.

BRIEF DESCRIPTION OF THE FIGURES

The accompanying drawings, which are incorporated in and form a part of the specification, illustrate an embodiment of the present invention and, together with the description, serve to explain the principles of the invention. In the drawings.

DETAILED DESCRIPTION OF THE PREFERRED EMBODIMENTS

Figure 1:
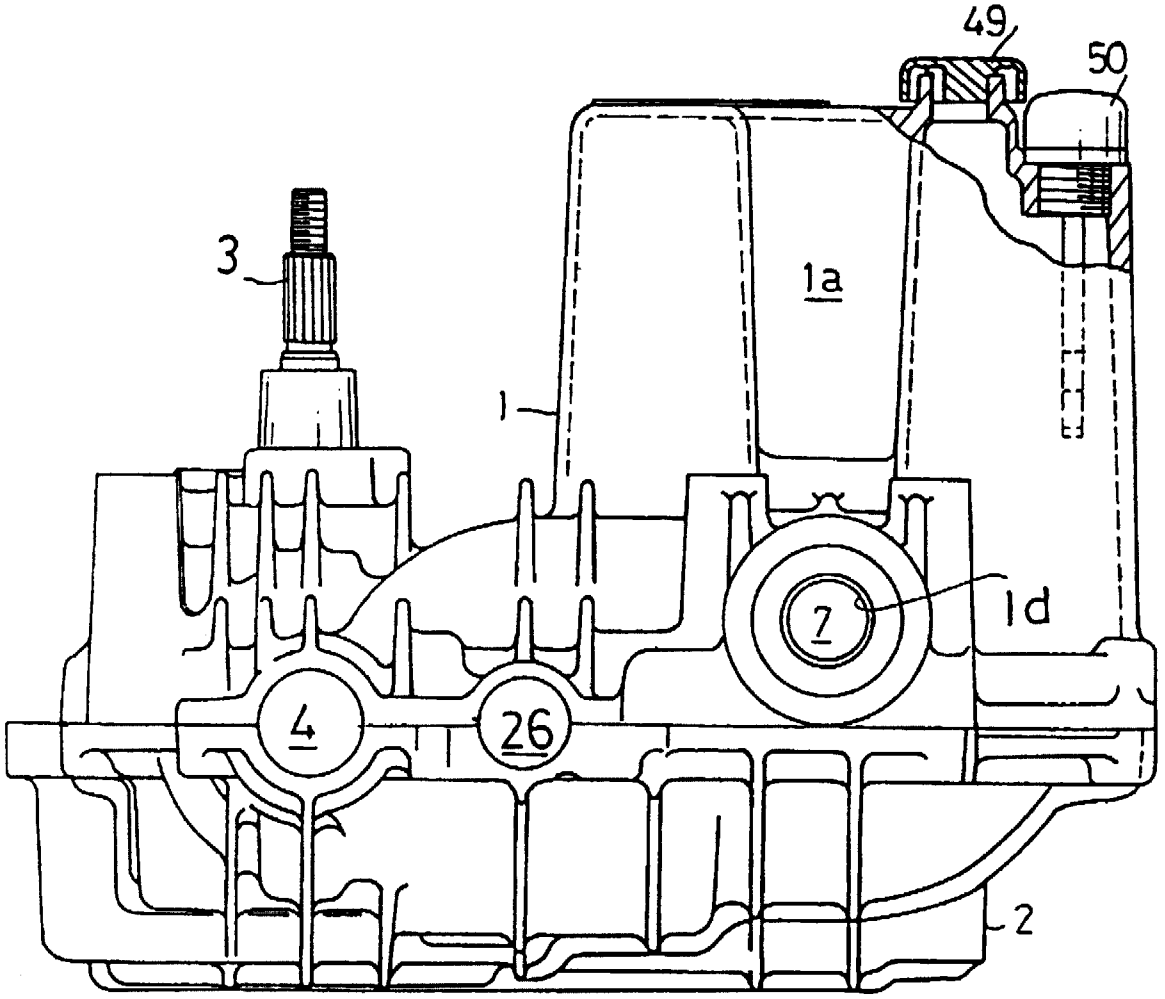
FIG. 1 is a side view of an axle driving apparatus in the axial direction of the axle, in which a variable displacement hydraulic system of the present invention is contained.

FIG. 1 is an external view of an axle driving apparatus. A housing, comprised of an upper half casing 1 and a lower half casing 2 are coupled together along peripheral, flat joint surfaces thereof. The housing contains therein a hydraulic pump, a hydraulic motor, a pair of right and left axles 7, a differential gear 23 for differentially coupling axles 7, and a power transmission unit for transmitting power from the hydraulic motor to the differential gear. At the joint surfaces of upper half casing 1 and lower half casing 2 are provided bearings for a hydraulic motor shaft 4 and a counter shaft 26. The bearings for axles 7 are supported to upper half casing 1 above the joint surfaces of upper half casing 1 and lower half casing 2 through bores 1*d* bored in upper half casing 1.

An upper projection used as an oil tank 1*a* is formed in upper half casing 1 where differential gear 23 is disposed. A breather cap 49 and an oil level gauge 50 screw with the top of oil tank 1*a*. A pump shaft 3 projects upwardly from upper half casing 1.

Figure 2:
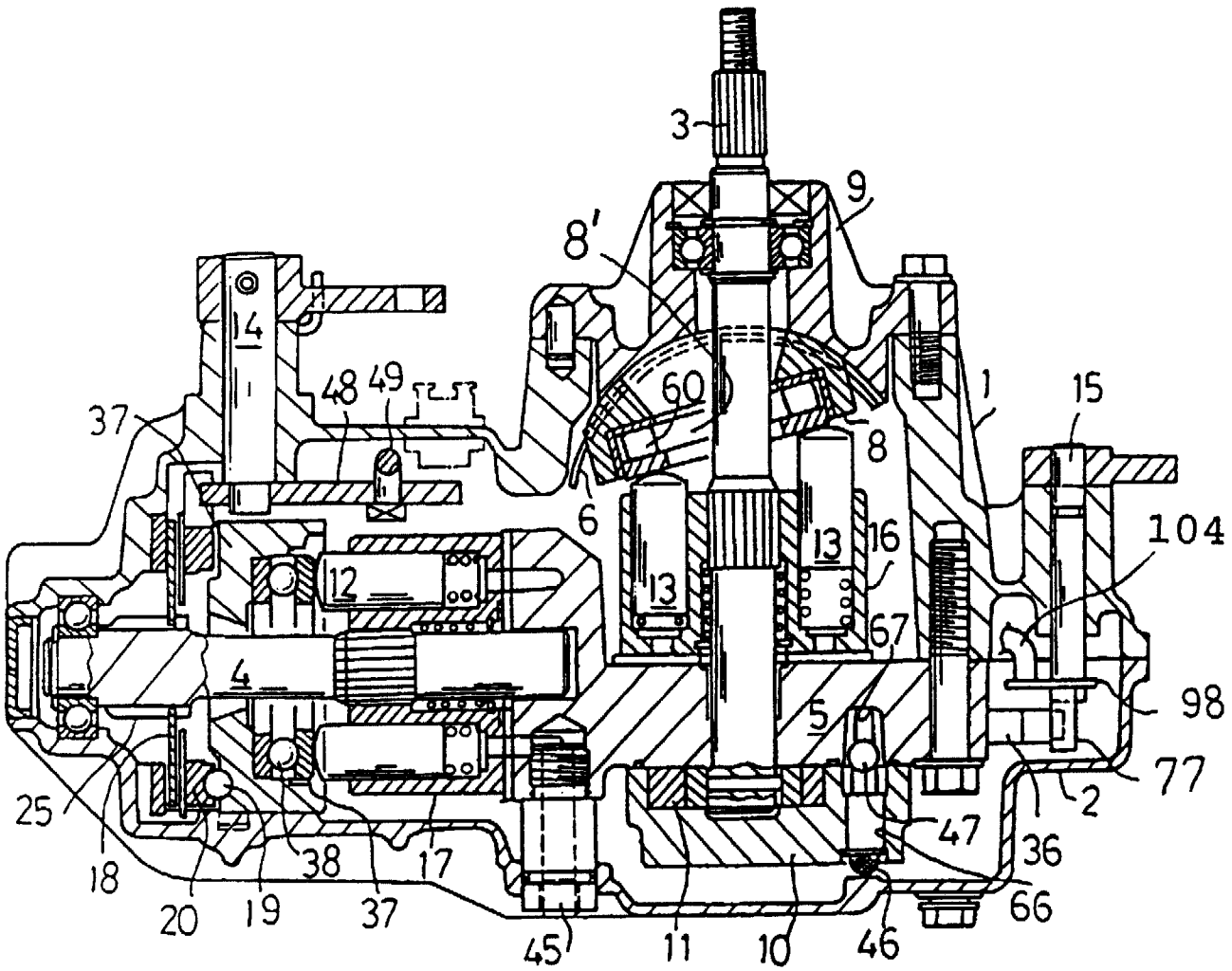
FIG. 2 is a cross sectional view of the axle driving apparatus of FIG. 1 taken along the arrows 2—2 in FIG. 4.

FIG. 2 is a cross-section taken perpendicular to the joint surfaces between upper half casing 1 and lower half casing 2. An L-shaped center section 5 is fixed to upper half casing 1. The upper horizontal surface of center section 5 forms a pump mounting surface onto which an axial piston hydraulic pump is mounted. The pump includes a cylinder block 16 which is rotatably and slidably mounted on center section 5. Cylinder block 16 is provided with a vertically extending rotary axis which engages with pump shaft 3 such that pump shaft 3 is coincident with the rotary axis of cylinder block 16. A plurality of pistons 13 are fitted into a plurality of cylinder bores provided in cylinder block 16 so that pistons 13 may freely project and retract from cylinder block 16. The head of each piston 13 abuts against the lower surface of a thrust bearing 60 which is fitted into a swash plate 8. A slot 8' is provided at the center of swash plate 8 through which pump shaft 3 extends. Outwardly curved portions are formed in circular arc at both sides of slot 8'. Concave surfaces, each of a curvature about equal to that of each outwardly curved portion, are formed inside a support member 9 for closing the opening of upper half case 1 through which pump shaft 3 extends.

Figure 9:
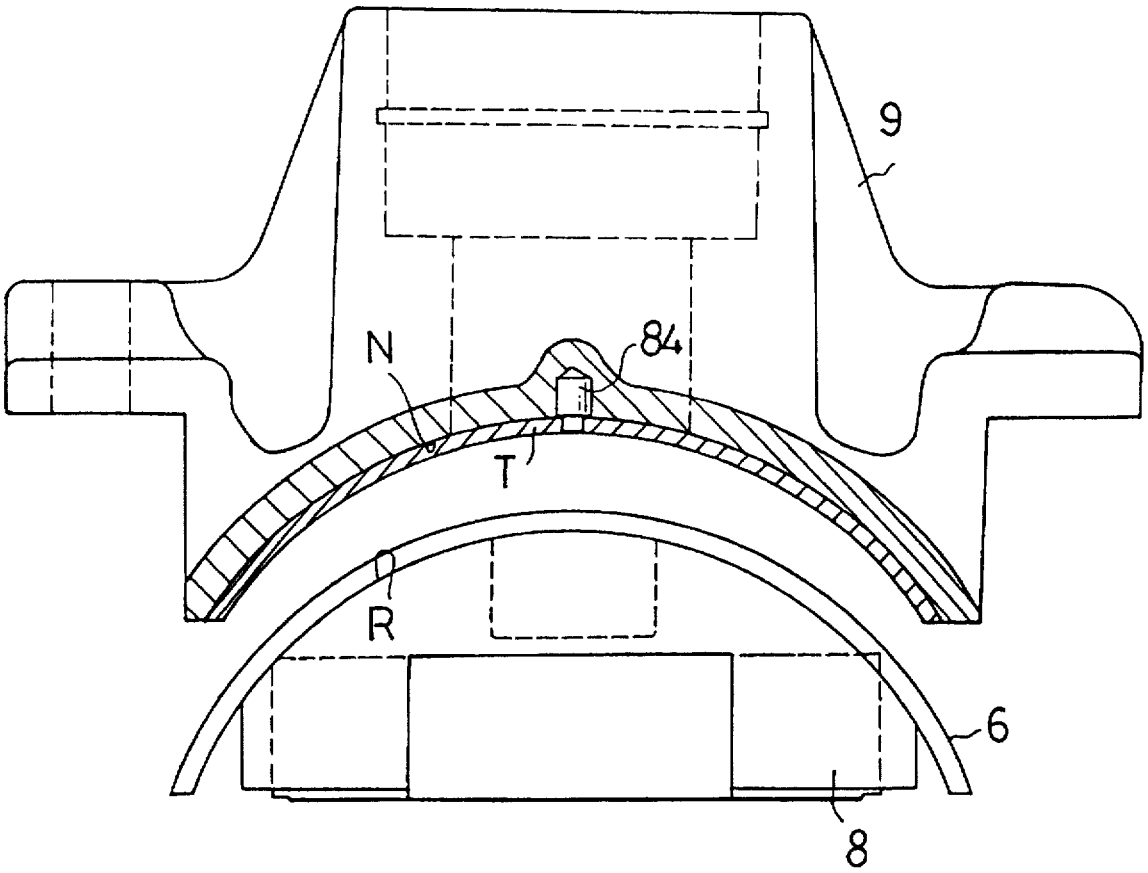
FIG. 9 is a cross sectional side view of a swash plate 8, a support member 9, thrust metal T and a plate 6.
Figure 17:
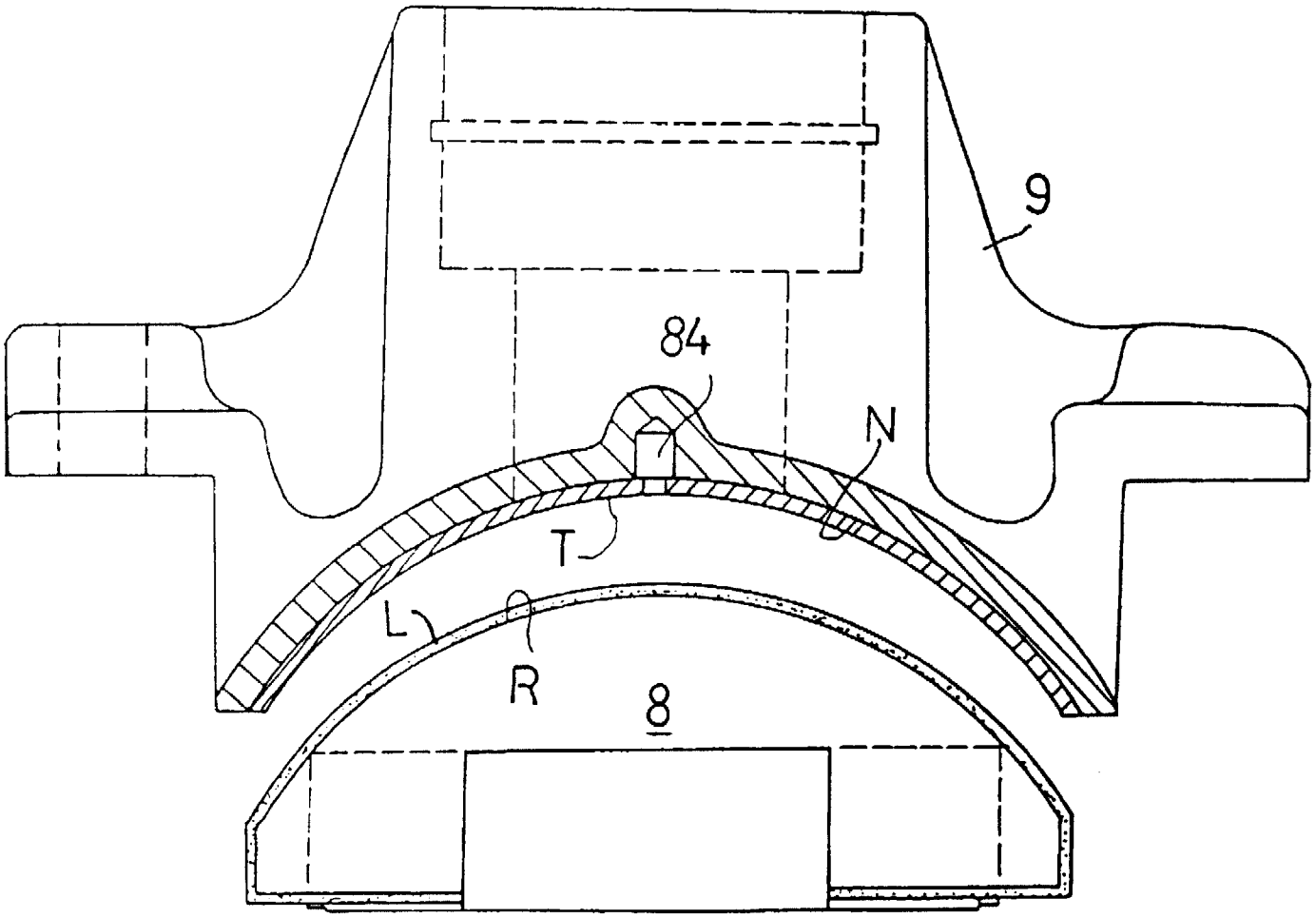
FIG. 17 is a sectional side view of another modified embodiment, in which a smooth surface layer L having a high sliding efficiency is provided instead of the plate 6.

On the concave portion of support member 9, thrust metal T coincident therewith is mounted by a pin 84 as shown in FIGS. 9 and 17. Thrust metal T is fabricated from any suitable material, such as a bronze sintered steel sheet or the like impregnated with, for example, TEFLON® or any other suitable material with a low coefficient of friction. Although this embodiment uses thrust metal T, if the concave surface itself formed in support member 9 can be given the same properties as thrust metal T via mechanical processing or chemicals such that it has a low coefficient of friction, the thrust metal T need not be used.

Support member 9 supports the upper end of pump shaft 3 and, in the above embodiment, is formed as a separate member for closing the opening of upper half casing 1. Alternatively, support member 9 may be integral with upper half casing 1. In the preferred embodiment, support member 9 is a part of the housing.

On one side surface of swash plate 8 are provided a pair of engageable projections 78 and a ball 30 at the utmost end of a swing arm 39. Swing arm 39 engages with projections 78 and ball 30 through a joint block (not shown). A control shaft 35 fixedly supporting swing arm 39 is rotatably supported to upper half casing 1. Control shaft 35 is disposed so that its longitudinal axis is parallel to the rotary axis of cylinder block 16. A portion of control shaft 35, projecting outwardly from upper half casing 1, fixedly supports an arm 35*a*.

Arm 35*a* is disposed in association with an operating lever (not shown) used by an operator. When the operator engages the lever to horizontally rotate arm 35*a*, swing arm 39 rotates together with control arm 35 so that swash plate 8 is moved laterally slantwise. When the lower surface (the surface abutting against pistons 13) of thrust bearing 60 held by swash plate 8 is put at a right angle with respect to the rotary axis of the cylinder block 16, swash plate 8 is in the neutral position so that no oil is discharged from the hydraulic pump. In this fashion, the stroke of pistons 13 is controlled according to the corresponding degree of slantwise rotation of swash plate 8. This allows the amount of oil discharged to be adjusted or the discharge direction to be reversed as the degree of slantwise rotation of swash plate 8 is adjusted.

The vertical surface of center section 5 forms a hydraulic motor mounting surface onto which an axial hydraulic motor is affixed. In detail, a cylinder block 17 is rotatably and slidably mounted on the motor mounting surface to orient the rotary axis thereof in the horizontal direction. A motor shaft 4 engages with cylinder block 17 so that their rotary axes coincide. A plurality of pistons 12 are fitted into a plurality of cylinder bores in cylinder block 17 so that they may freely project from and retract into the bores. The heads of pistons 12 abut against thrust bearings 38 of fixed swash plate 37. Fixed swash plate 37 is fixedly sandwiched between upper half casing 1 and lower half casing 2. Pressurized oil discharged from cylinder block 16 flows into cylinder block 17 through a closed fluid circuit within center section 5, whereby a torque is generated at cylinder block 17, causing motor shaft 4 to rotate. Therefore, when swash plate 8 is rotated slantwise from the neutral position, stepless output rotation of motor shaft 4 is obtained. This combination of the hydraulic pump with the hydraulic motor constitutes a hydrostatic transmission.

At the pump mounting surface and motor mounting surface of the center section 5 are a pair of open kidney ports (not shown) communicating with suction and discharge ports of cylinder blocks 16 and 17. A pair of oil passages 69 and 70 communicating with the kidney ports are provided within center section 5 to constitute a closed circuit for circulating operating oil between the hydraulic pump and the hydraulic motor.

Onto the lower surface of center suction 5, a charge pump casing 10 is attached, in which a charge pump 11 of the trochoid type is disposed. Charge pump 11 engages with the lower end of pump shaft 3 and projects from the lower surface of center section 5. Also, a plugged lubricating pipe 45 is mounted at the lower surface of center section 5. The utmost end of pipe 45 projects outwardly from the lower surface of lower half case 2. The lubricating pipe 45 is for charging the operating oil into the closed circuit after the hydraulic pump and motor are assembled in the housing.

Figure 6:
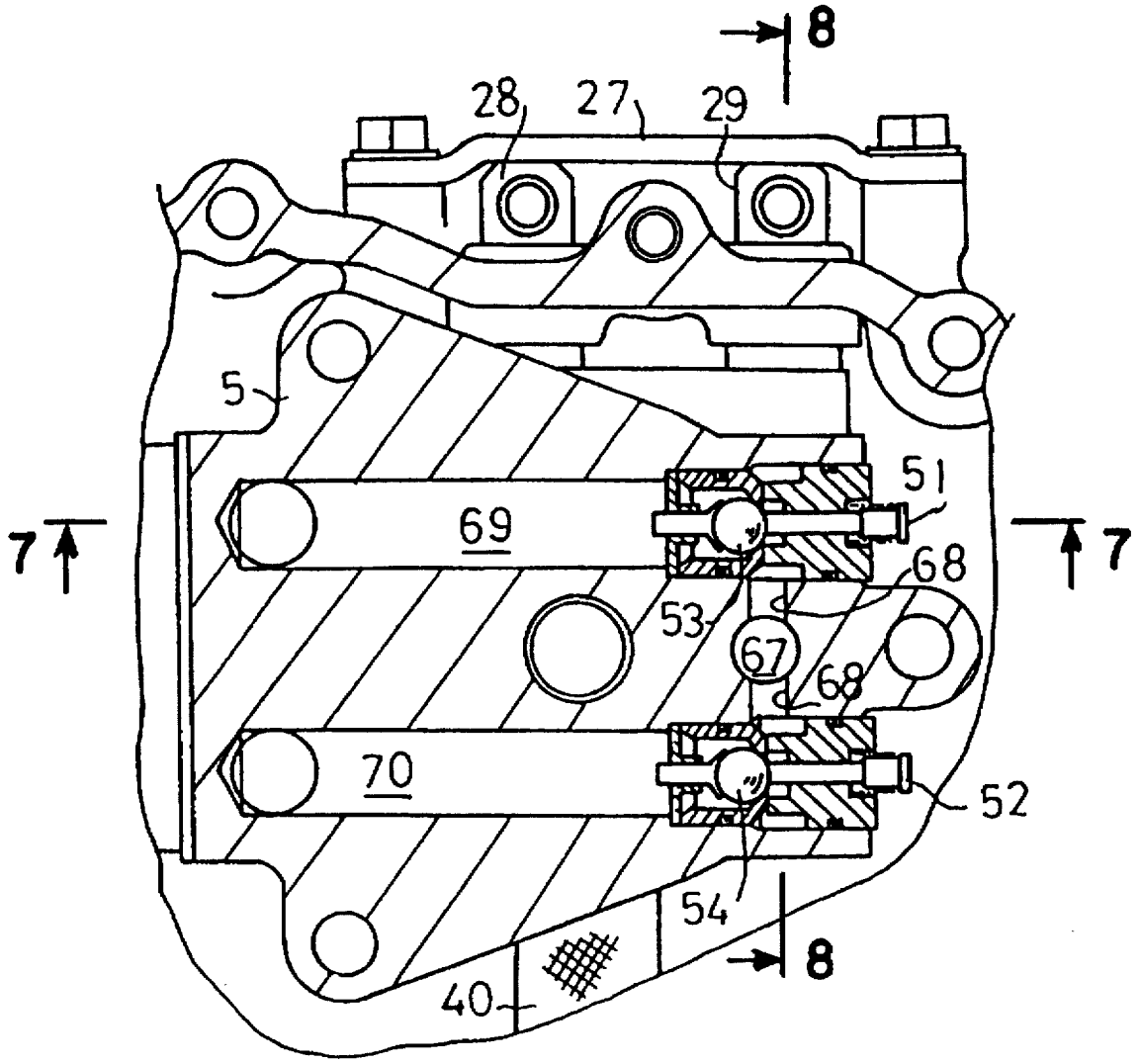
FIG. 6 is a cross sectional view taken along the arrows 6—6 in FIG. 3.
Figure 8:
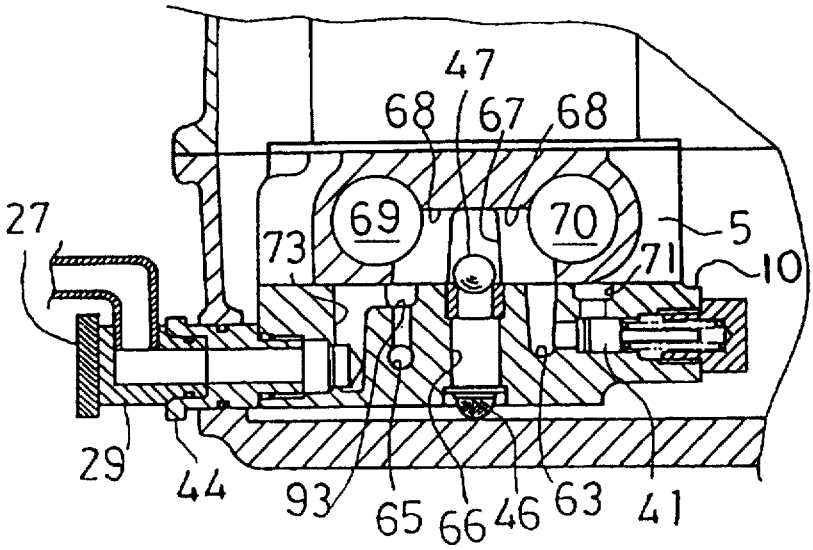
FIG. 8 is a cross sectional view taken along the arrows 8—8 in FIG. 6.

A suction oil passage 66 for a first check valve 47 is provided within charge pump casing 10. An oil filter 46 is disposed at an end of suction oil passage 66 which opens into the housing. Oil filter 46 is fixedly sandwiched between the lower surface of charge pump casing 10 and the inner surface of lower half casing 2. As shown in FIGS. 6 and 8, the operating oil, taken into the housing through check valve 47, is divided into left and right oil passages 68 from an oil passage 67 and taken into either low pressure sides of oil passages 69 and 70 through a pair of second check valves 53 and 54.

Figure 3:
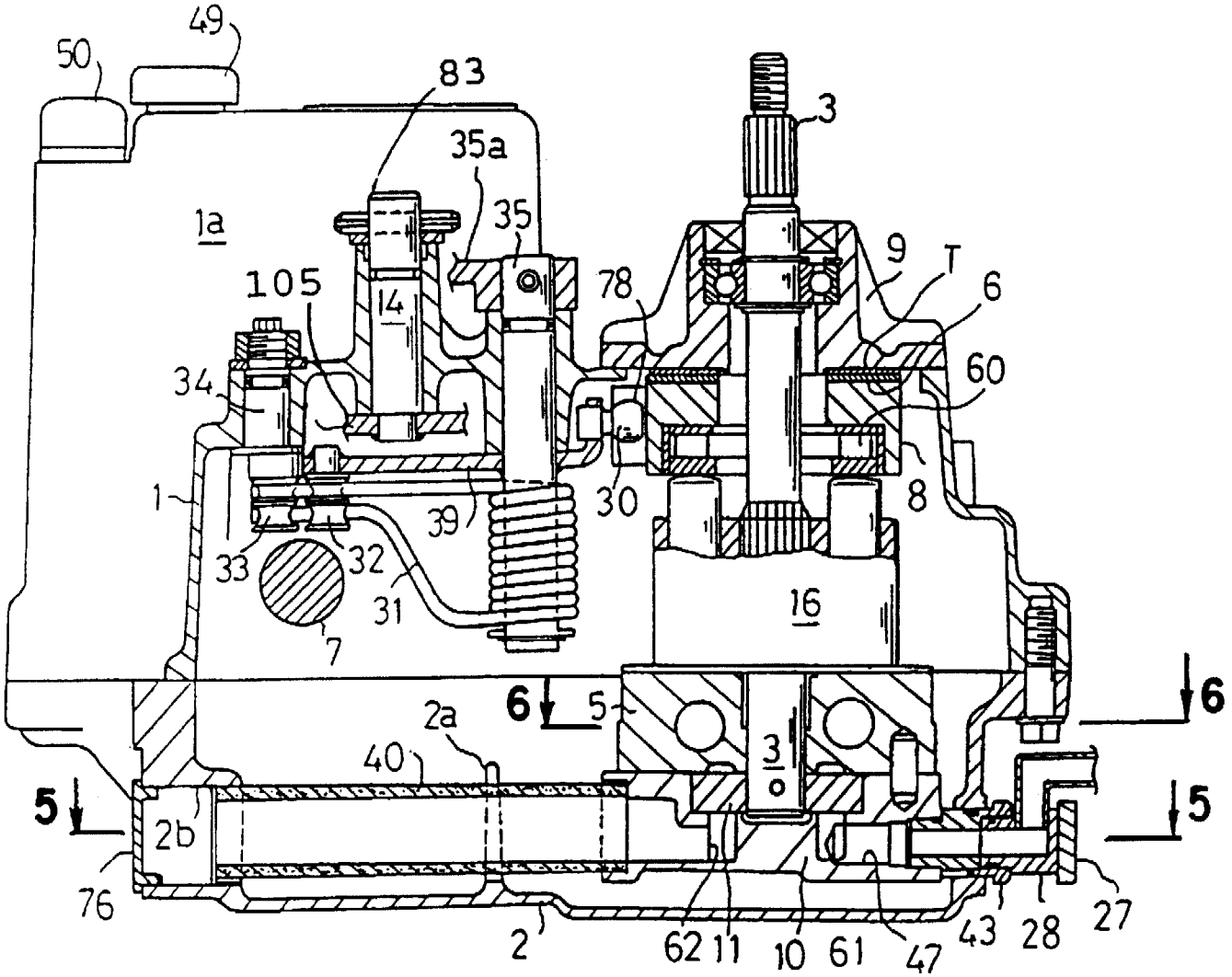
FIG. 3 is a cross sectional view of the axle driving apparatus of FIG. 1 taken along the arrows 33 in FIG. 4.
Figure 5:
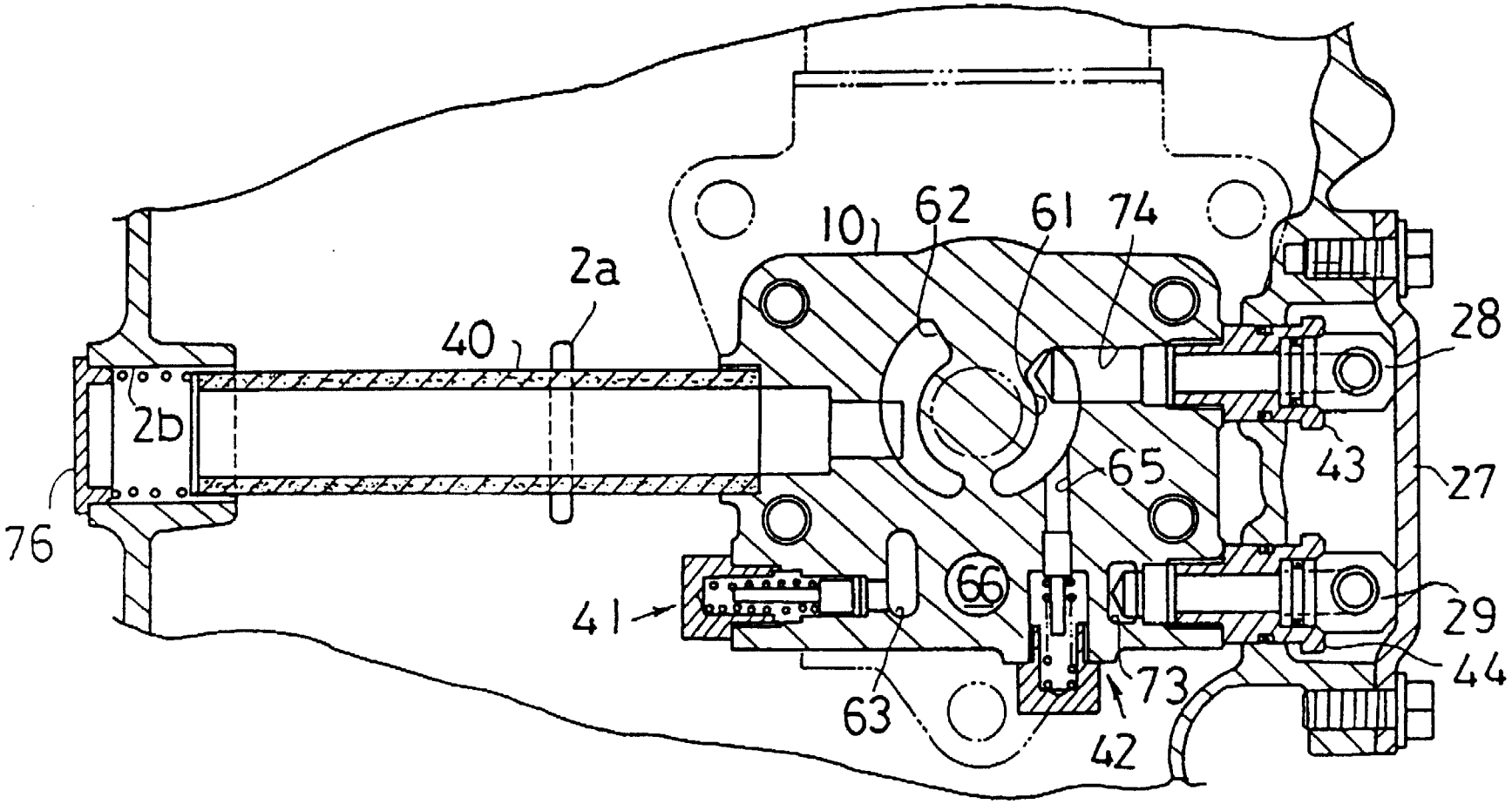
FIG. 5 is a cross sectional view taken along the arrows 5—5 in FIG. 3.

As shown in FIG. 5, operating oil is introduced into suction side oil passage 62 of charge pump 11. This operating oil is then taken through a separate oil filter 40. The oil filter 40 is formed of tubular mesh and, as shown in FIGS. 3 and 5, spans between the side wall of charge pump case 10 and the side wall of lower half casing 2. At the side wall of lower half case 2 is a firing bore **2*b* for laterally inserting oil filter 40 into lower half casing 2. Fitting bore 2*b* is closed by a blind lid 76. In a case where oil filter 40 is checked, cleaned or replaced, blind lid 76 is removed so as to enable oil filter 40 to be taken out of the housing. A support base 2*a* for oil filter 40 projects from the inner bottom surface of the lower half casing 2 and guides and supports the oil filter 40**.

Figure 7:
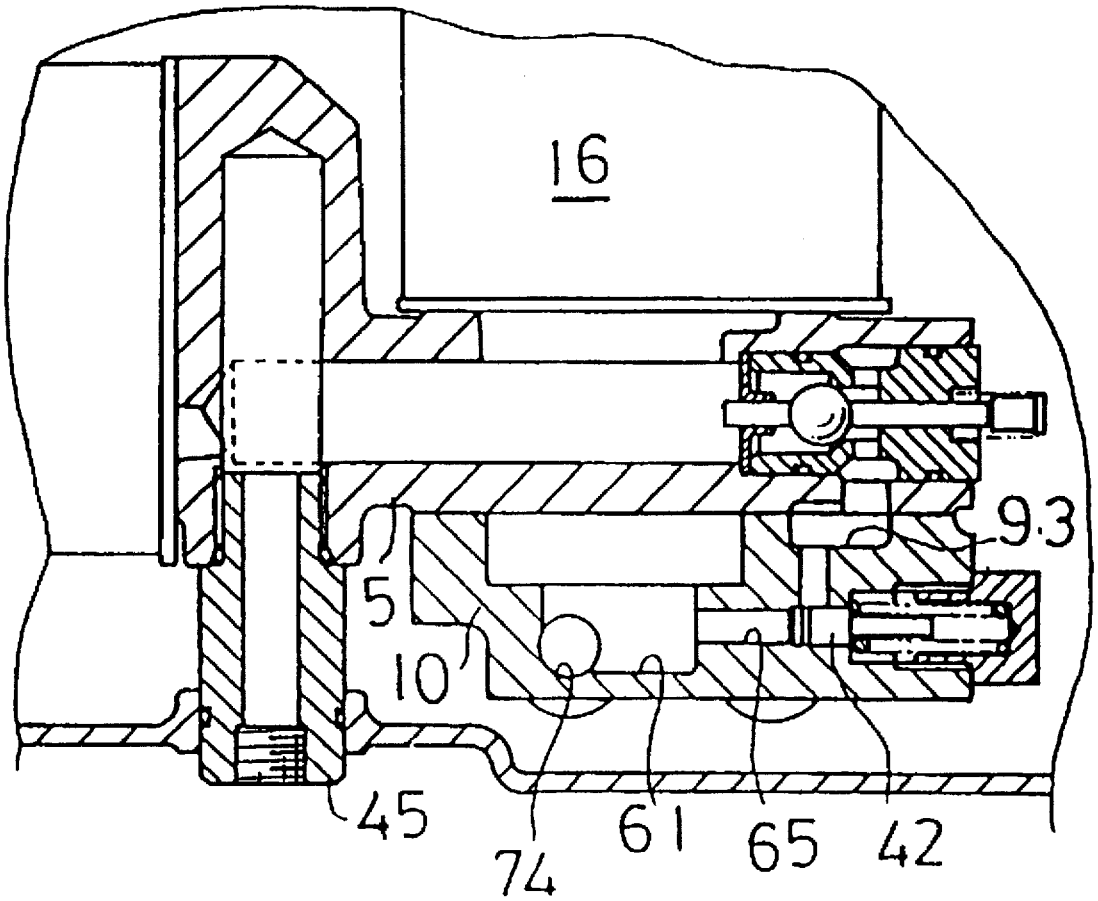
FIG. 7 is a cross sectional view taken along the arrows 7—7 in FIG. 6.

Discharged oil from discharge side oil passage 61 at charge pump 11 is supplied to an actuator, such as an external hydraulic cylinder, through oil passage 74, a pressure oil takeout port 43, and pressure oil take out joint 28 as shown in FIGS. 5, 7 and 8. Return oil from the actuator returns to an oil passage 68 at second check valves 53 and 54 through a return oil joint 29, a return oil inlet port 44, an oil passage 73, and an oil passage 93 as shown in FIG. 8. The discharge side oil passage 61, as shown in FIGS. 5 and 7, communicates with a relief valve 42 through an oil passage 65. The relief valve 42 is open when discharged oil from charge pump 11 reaches the pressure required to operate the actuator. The excess oil then flows from oil passage 93 into oil passages 68 of second cheek valves 53 and 54.

Pressurized oil flows from return oil joint 29 to oil passage 68, into oil passage 93, and through oil passage 73.

A charge relief valve 41, as shown in FIG. 8, communicates with oil passages 67 and 68 between second check valves 53 and 54. The pressurized oil is guided into charge relief valve 41 from oil passage 68 through oil passage 63, and when pressurized oil guided into the oil passages 67 and 68 reaches the specified pressure, charge relief valve 41 is opened and the excess oil is discharged into the housing. The oil, now adjusted to a lower pressure, is supplied to the low pressure side of oil passage 69 or 70.

As shown in FIG. 5, pressure oil takeout joint 28 and return oil joint 29 are fixed to the side wall of lower half casing 2 by a joint fixing bracket 27. The bases of the pressure oil takeout port 43 and return oil inlet port 44 perforate through bores formed at the side wall of lower half casing 2 and screw with the threaded bores at charge pump case 10. The bores at lower half casing 2, pressure oil takeout port 43, and return oil inlet port 44 are sealed so as to create an oiltight structure. The pressure oil takeout joint 28 is fitted into pressure oil takeout port 43 and return oil joint 29 is fitted into return oil inlet port 44 such that the fittings are oiltight. The outside of pressure takeout joint 28 and return oil joint 29 are locked by a joint fixing bracket 27. Also, as shown in FIGS. 3 and 6, a pair of oil pressure pipes extending from pressure oil takeout joint 28 and return oil joint 29 bend so that they pass perpendicularly above joint fixing bracket 27.

Figure 4:
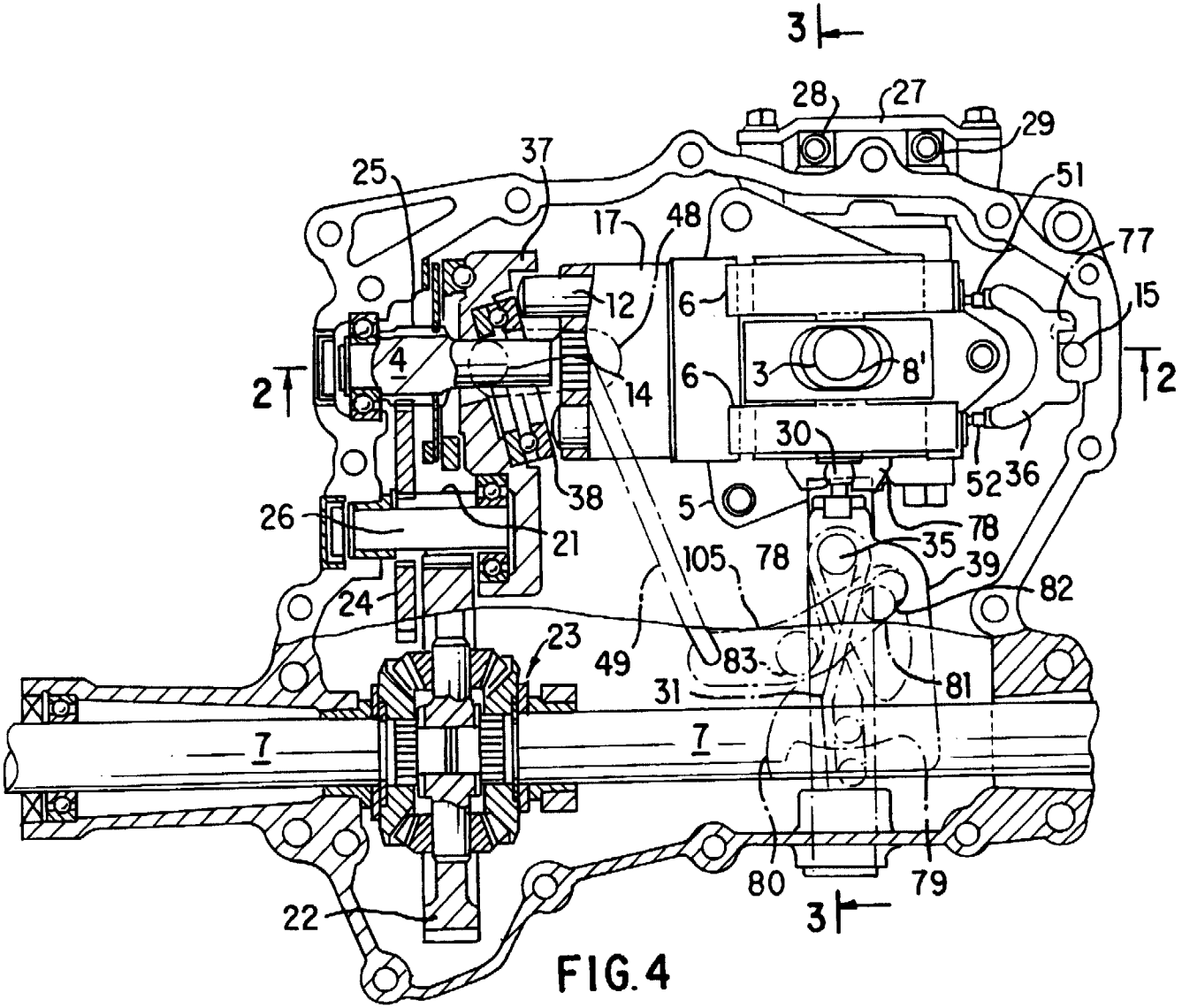
FIG. 4 is a partial cross sectional plan view of the axle driving apparatus of FIG. 1 with the upper half casing 1 removed.

As shown in FIGS. 4 and 6, push rods 51 and 52, which enable second check valves 53 and 54 to be released from the exterior of the housing, project from center section 5. A C-shaped bypass operating member 36 for simultaneously pushing push rods 51 and 52 abuts against the external ends of push rods 51 and 52. The bypass operating member 36 is engaged by a bypass operating lever shaft 15 shown in FIGS. 2 and 4. An eccentric and fixed pin 77 is provided at the lower end of the bypass operating lever 15. As the bypass operating lever 15 rotates, the pin 77 biases the rear of the bypass operating member 36 and the uppermost ends thereof simultaneously push the push rods 51 and 52. The second check valves 53 and 54 are released so that the oil passages 69 and 70 can be open in the housing. Hence, the hydraulic motor is freely rotatable and it is possible to haul the vehicle with minimum resistance imparted on the axle driving apparatus.

An arm 98, which engages an arm 48 through a link 49 and an interlocking link 104 is fixed at the lower portion of bypass operating lever 15. An interlocking link 104 is interposed between arm 98 and arm 48 at a side of a brake operating shaft 14. When brake operating shaft 14 exerts the braking action onto motor shaft 4, the bypass operating member 36 simultaneously operates to close check valves 53 and 54.

One end of the arm 48 at brake operating shaft 14 engages with an annular brake actuator 20 through a cam. When brake actuator 20 rotates around the axis of motor shaft 4, a cam ball 19 rides on shallows of a cam groove provided at fixed swash plate 37 so as to bias brake actuator 20 toward braking fiction plate 18 fixed to motor shaft 4. This acts to sandwich braking fiction plate 18 between brake actuator 20 and the housing, thereby stopping the rotation of motor shaft 4.

Motor shaft 4 is provided with a gear 25 which engages with a larger diameter gear 24 on a counter shaft 26. A smaller diameter gear 21 on the countershaft 26 engages with a ring gear 22 at the differential gear 23 to comprise a power transmission. The ring gear 22 drives the differential gear 23, which transmits power to the left and right axles 7. In the above embodiment, the counter shaft 26 is journalled at one end to part of the fixed swash plate 37.

Next, as shown in FIGS. 3 and 4, a helical return spring 31 is wound around the control shaft 35. The helical return spring 31 provides a return force to return the swash plate 8 to the neutral position. Both ends of the return spring 31 cross each other approximately halfway so as to sandwich therebetween a fixed pin 33 provided at the housing and a movable pin 32 provided on the swinging arm 39.

An adjusting screw 34 for adjusting the neutral position is provided at the inner surface of the upper half casing 1. The fixed pin 33 is provided at the lower end of the adjusting screw 34 so that the adjusting screw 34 rotates to shift the fixed pin 33, thereby enabling the swash plate 8 to be adjusted to an accurate neutral-position. The movable pin 32, when the swash plate 8 is slanted forwardly or backwardly, deflects the return spring 31 to apply the return force to the swash plate 8. When the operator does not rotate the swash plate 8 slantwise, the swash plate 8 can automatically and quickly return to the neutral position by the force of return spring 31. The other end of the swinging arm 39 is formed in a fan-shape, and at the peripheral edges thereof a pair of engaging projections 79 and 80 are provided which abut against the fixed pin 33 to thereby regulate the slanting range of swash plate 8.

Swing arm 39 is provided with a cam bore 82 which, when brake operating shaft 14 is rotated to brake motor shaft 4, returns swash plate 8 to the neutral position. A pin 81 is inserted into cam bore 82 and fixed to an arm 105 rotating around a relay shaft 83. When rotation of motor shaft 4 is stopped, the arm 105 is rotated by link 49 connected to brake operating shaft 14, and pin 81 is shifted. This force returns swing arm 39 to the neutral position through cam bore 82. When the brake is not engaged, pin 81 is disposed in a wide position and swing arm 39 freely rotates to thereby enable swash plate 8 to be rotated slantwise.

The axle driving device of the present invention is intended to reduce the force required to operate control shaft 35 to rotate swash plate 8 slantwise. Conventionally, the inner surface of the thrust metal T mounted at the housing forms a slidable contact surface with respect to the outwardly curved portion of swash plate 8. Swash plate 8 rotates slantwise at its outwardly curved portion along the contact surface of the thrust metal T. This configuration requires excessive force to rotate swash plate 8 due to frictional resistance generated at the outwardly curved portion of swash plate 8. In the present invention, a smooth surface layer having a high sliding efficiency is provided at the outwardly curved portion R of swash plate 8, thereby eliminating such resistance.

An arcuate steel plate 6, integrally connected to swash plate 8, serves as an example of such a surface layer. In the embodiment depicted in FIG. 10, a pair of arcuate plates 6 equal in width to the outwardly curved portion R of swash plate 8 are fixed thereto in such a manner so that projections 85 extending from outwardly curved portions R are fitted into bores 88 which are formed in arcuate plates 6. Preferably, the arcuate plates 6 is steel. Swash plate 8 is preferably formed by non-mechanical processing techniques such as die casting or sintering, whereby projections 85 can be simultaneously formed with swash plate 8.

Figure 11:
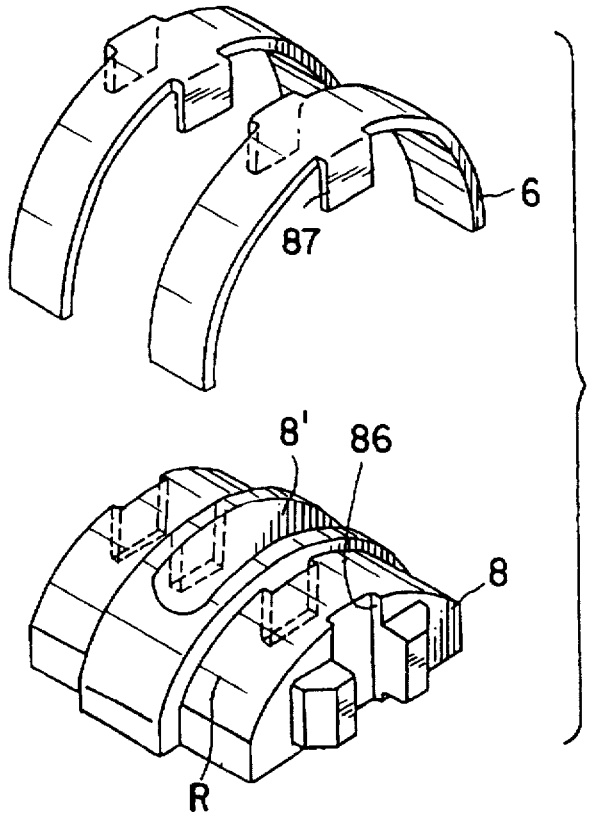
FIG. 11 is a perspective view of a second embodiment, in which two plates 6 are affixed to swash plate 8.

In the embodiment depicted in FIG. 11, recesses 86 are formed at both side-surfaces of outwardly curved portion R of swash plate 8. Two arcuate plates 6, preferably, made of the same material as the arcuate plates 6, are each provided at both sides thereof with bent projections 87 which fixedly mate with recesses 86. In the embodiment depicted in FIG. 12, bent portions 89 are provided at each end of plates 6 which fit into outwardly curved end surface 90 provided on swash plate 8, thereby enabling arcuate plates 6 to be simply fixed to swash plate 8.

Figure 10:
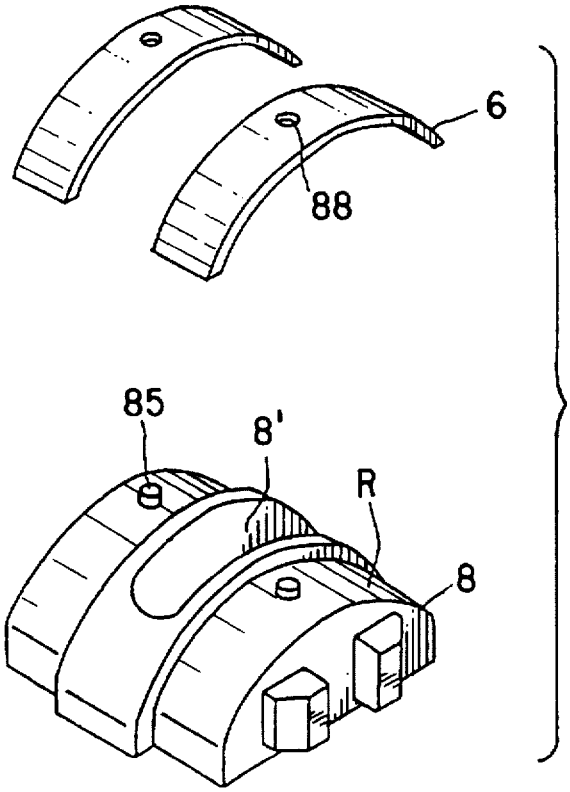
FIG. 10 is a perspective view of a first embodiment of the present invention, in which plate 6 is affixed to swash plate 8.
Figure 13:
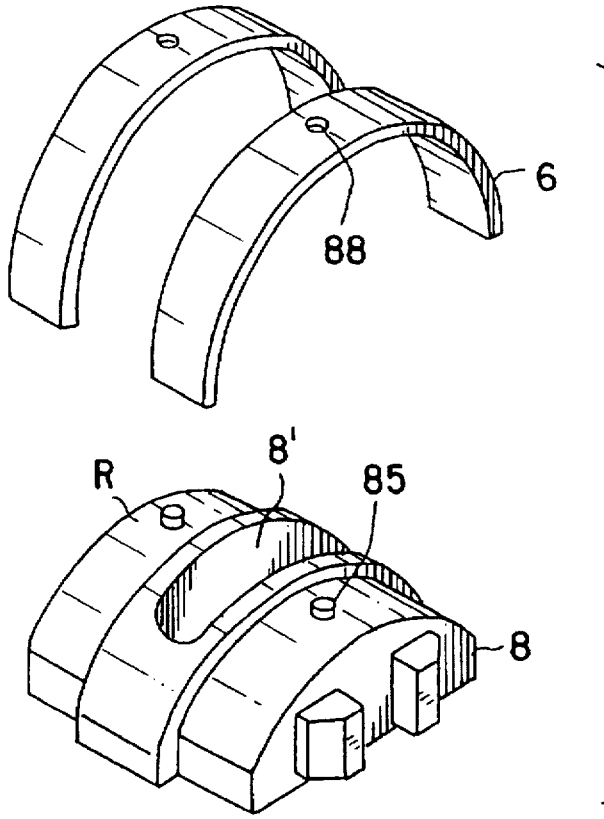
FIG. 13 is a perspective view of a fourth embodiment, in which the plates 6 are longer than swash plate 8 and are affixed thereto.

The embodiment depicted in FIG. 13 is similar to the embodiment depicted in FIG. 10 in that projections 85 are provided on outwardly curved portion R of swash plate 8 and bores 88 are provided in arcuate plates 6; however in this embodiment, arcuate plates 6 have a longer peripheral length than outwardly curved portion R. In this case, even when swash plate 8 rotates slantwise at severe angles, the upper surface of arcuate plates 6 and the thrust metal T are always against each other. Hence, the operating force can be reduced throughout the entire range of operation of swash plate 8. FIG. 2 also discloses the swash plate 8 of this embodiment in which arcuate plates 6 of larger peripheral length are utilized. The fixing structure depicted in FIG. 11 also shows arcuate plates 6 having a longer peripheral length than outwardly curved portion R.

Figure 12:
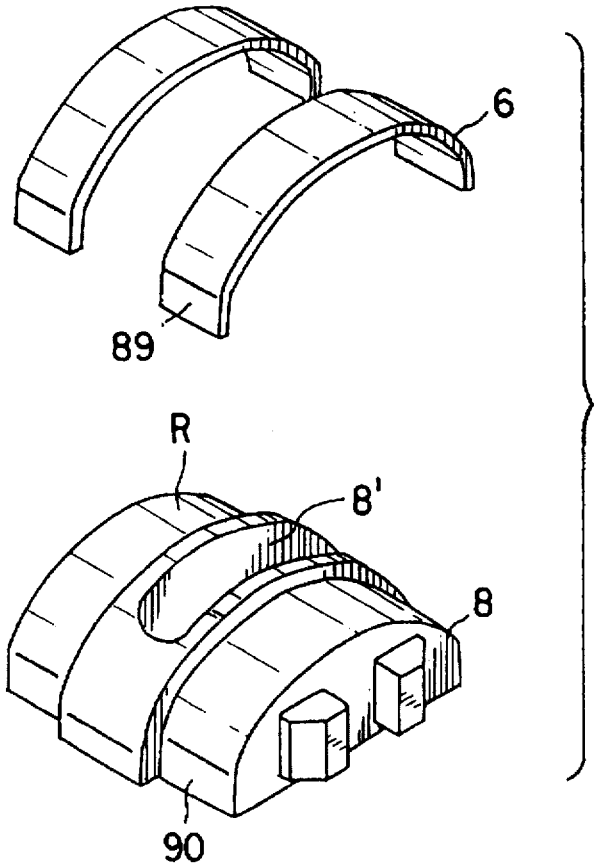
FIG. 12 is a perspective view of a third embodiment, in which the two plates 6 are also affixed to swash plate 8.
Figure 14:
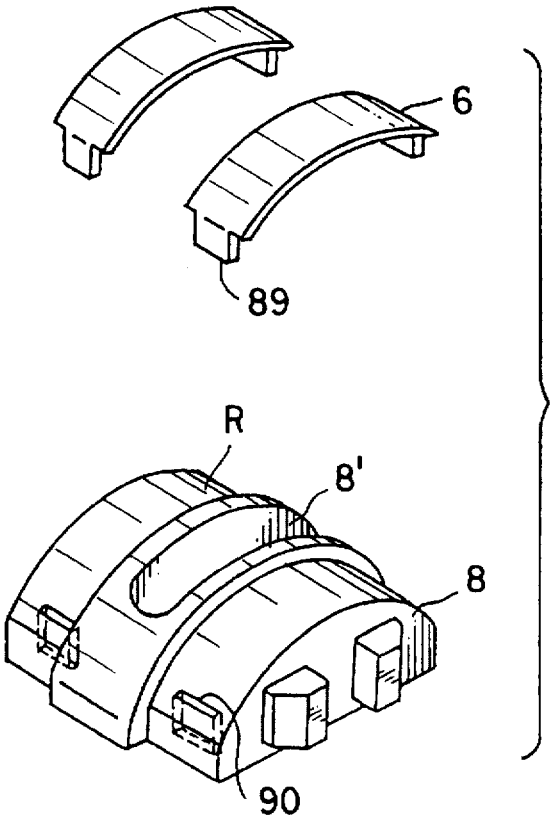
FIG. 14 is a perspective view of a fifth embodiment, in which plates 6 are affixed to swash plate 8.
Figure 15:
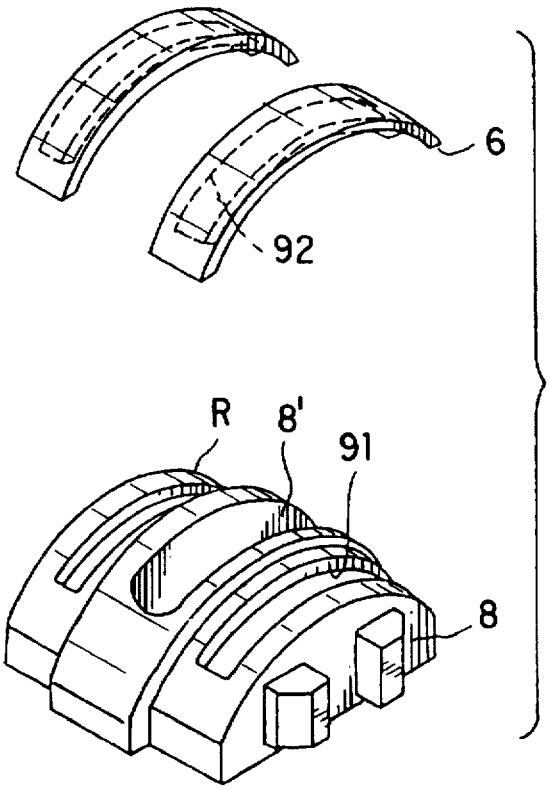
FIG. 15 is a perspective view of a sixth embodiment, in which plates 6 are affixed to swash plate 8.

In the embodiment depicted in FIG. 14, bent portions 89 are formed at both ends of arcuate plates 6 in the same fashion as that of FIG. 12, but recesses 90 are provided in outwardly curved portion R of swash plate 8 so that bent portions 89 are inserted into recesses 90, thereby fixing arcuate plates 6 to swash plate 8. In the embodiment depicted in FIG. 15, arcuate plates 6 are integrally cast onto the surface of curved portion R during the processing stage of swash plate 8 by casting or alloying. Hence, a projection 92 of each arcuate plate 6 is mated with recess 91 formed in outwardly curved portion R, thereby fixing arcuate plates 6 to swash plate 8. In this embodiment, even the assembly step for fixing arcuate plates 6 to swash plate 8 can be omitted.

Figure 16:
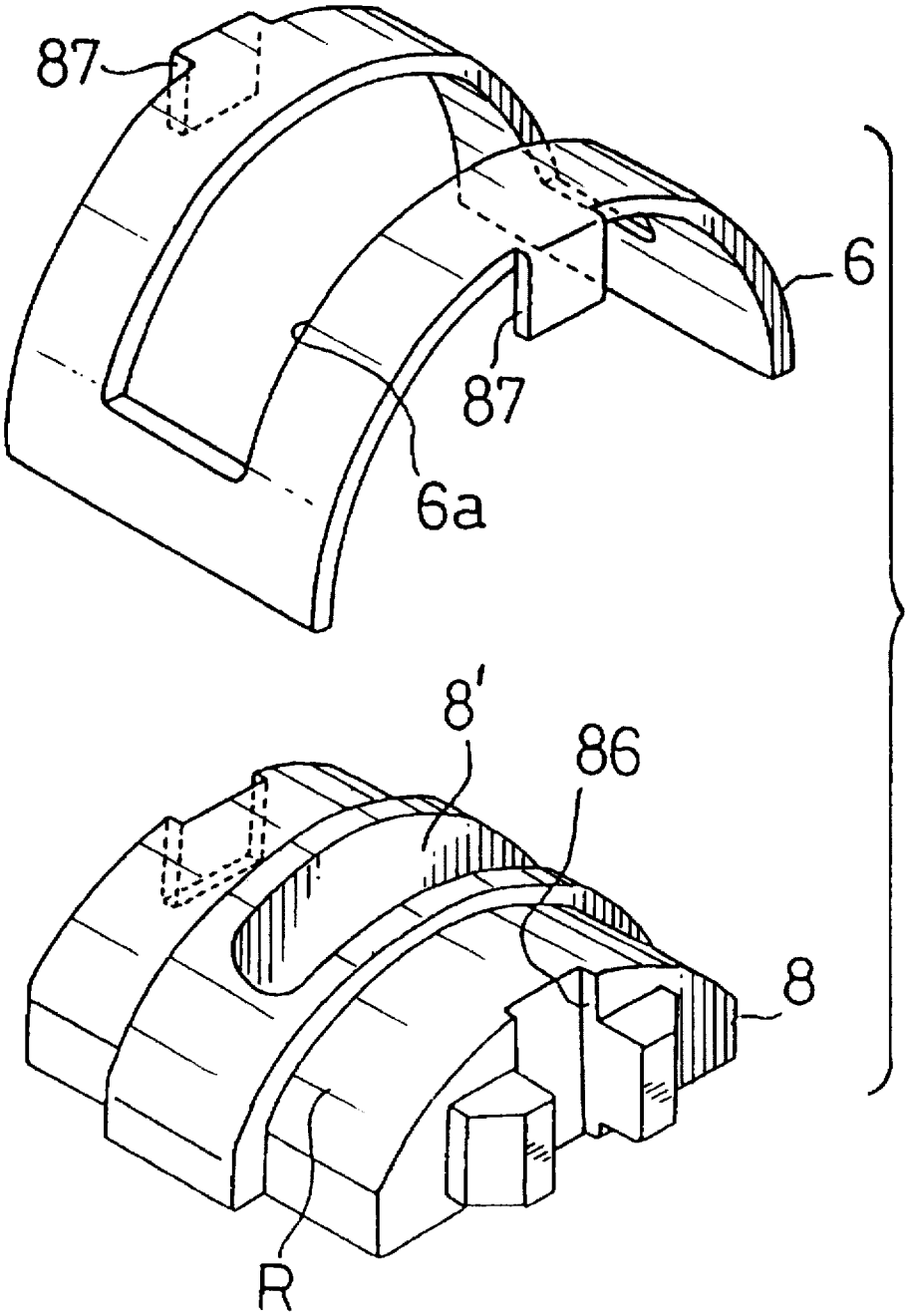
FIG. 16 is a perspective view of a modified embodiment, in which plate 6 is different in formation.

The structures as shown in FIGS. 10 to 15 mount a pair of the arcuate plates 6 onto curved portions R positioned at swash plate 8. As shown in FIG. 16, the arcuate plate 6 can instead be formed as a single piece, for example as a flat steel sheet which is square when viewed from above. Plate 6 in this embodiment has an opening **6*a* through which pump shaft 3 extends, and is curved in an arc to coincide with outwardly curved portion R of swash plate 8. The arcuate plate 6 may be mounted onto the outwardly curved portion R of swash plate 8 by mating projections 87 formed on arcuate plate 6 with recesses 86 provided at outwardly curved portion R. As for the mounting arcuate plate 6 according to the embodiment, any one of the above-mentioned constructions may be used. Further, the arcuate plate 6 is intended to be longer in peripheral length than the outwardly curved portion of swash plate 8. Arcuate plate 6, when formed as a single part, can be mounted onto outwardly curved portion R of swash plate 8** in a single step, thereby facilitating its assembly.

Figure 21:
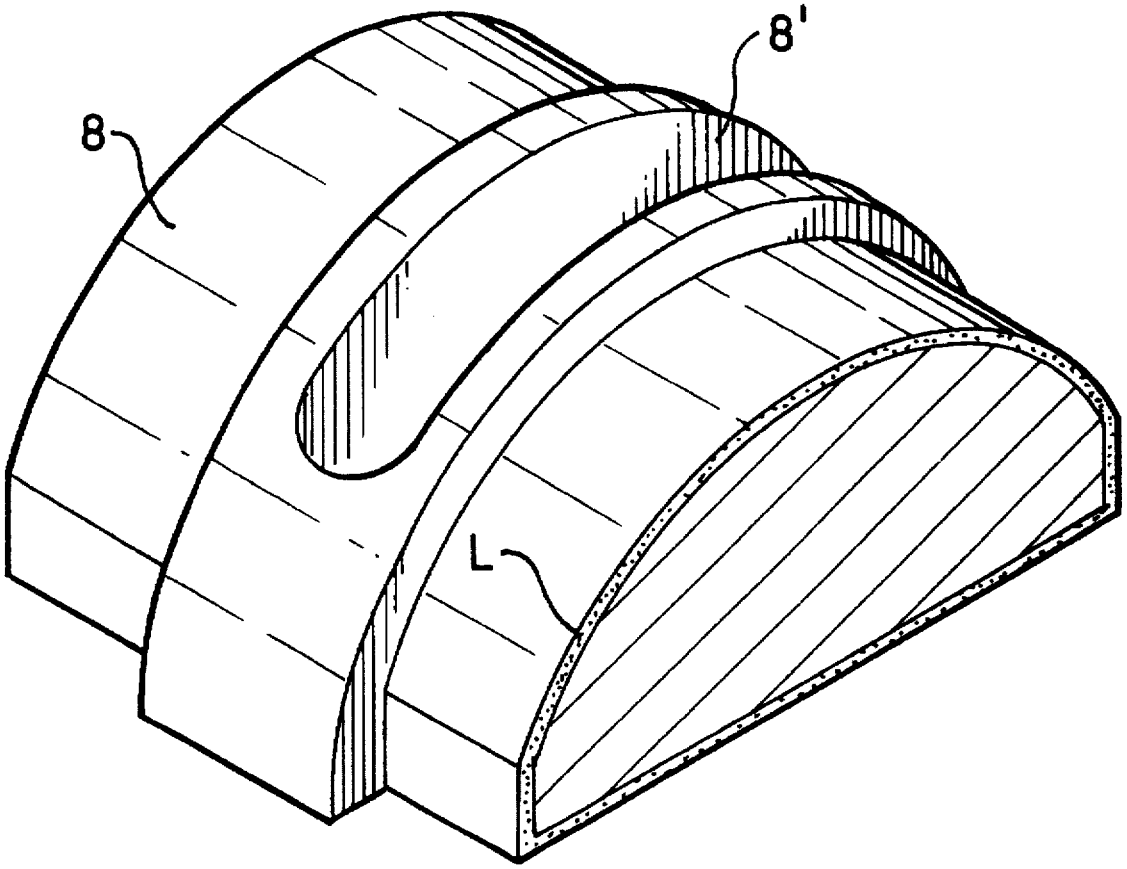
FIG. 21 is a perspective sectional view of the modified embodiment shown in FIG. 17, in which a smooth surface layer having a high sliding efficiency is provided on the swashplate.

As shown in FIGS. 17 and 21 FIG. 17, the surface layer L provided at outwardly curved portion R of swash plate 8 may have a smooth surface having a high sliding efficiency as an alternative to using arcuate plate 6. This surface layer L can be obtained by applying a chemical metal processing to the swash plate 8, which is formed from ferrous metal.

One of the chemical metal processes available is to employ nitriding techniques to produce a compound surface layer L of iron nitride on swash plate 8. Since the compound surface layer L is metallic, it has the advantages of having superior wear and seizure resistance, a low coefficient of friction, and of being ideally adaptable for use in sliding contact applications.

Swash plate 8 may alternately be immersion processed so that a relatively thin, insoluble film L of manganate phosphate of 5 to 15 μ in thickness may be provided to the surface of ferrous metal swash plate 8. This homogeneous, hard film of manganate phosphate provides superior wear and seizure resistance. Its porous crystal structure gives it superior oil absorption and retention properties so as to facilitate lubrication for sliding applications. These techniques of applying chemicals can be employed to form a surface layer of high hardness, high seizure limit, low coefficient of friction, and easy adaptability to the mating object. This results in a low friction contact surface between the smooth surface layer L, having a high sliding efficiency, and the thrust metal T.

As seen from the above, when the smooth surface layer L having a high sliding efficiency is formed on the outwardly curved portion R of swash plate 8, the sliding resistance thereof is reduced so as to enable the expected improvement in operability in manual movement of swash plate 8 as well as in the automatic return of the swash plate 8 to the neutral position. While the costs associated with manufacturing such a swash plate 8 are higher, its superior low-fiction properties and ease of assembly render it to be most beneficial.

Figure 18:
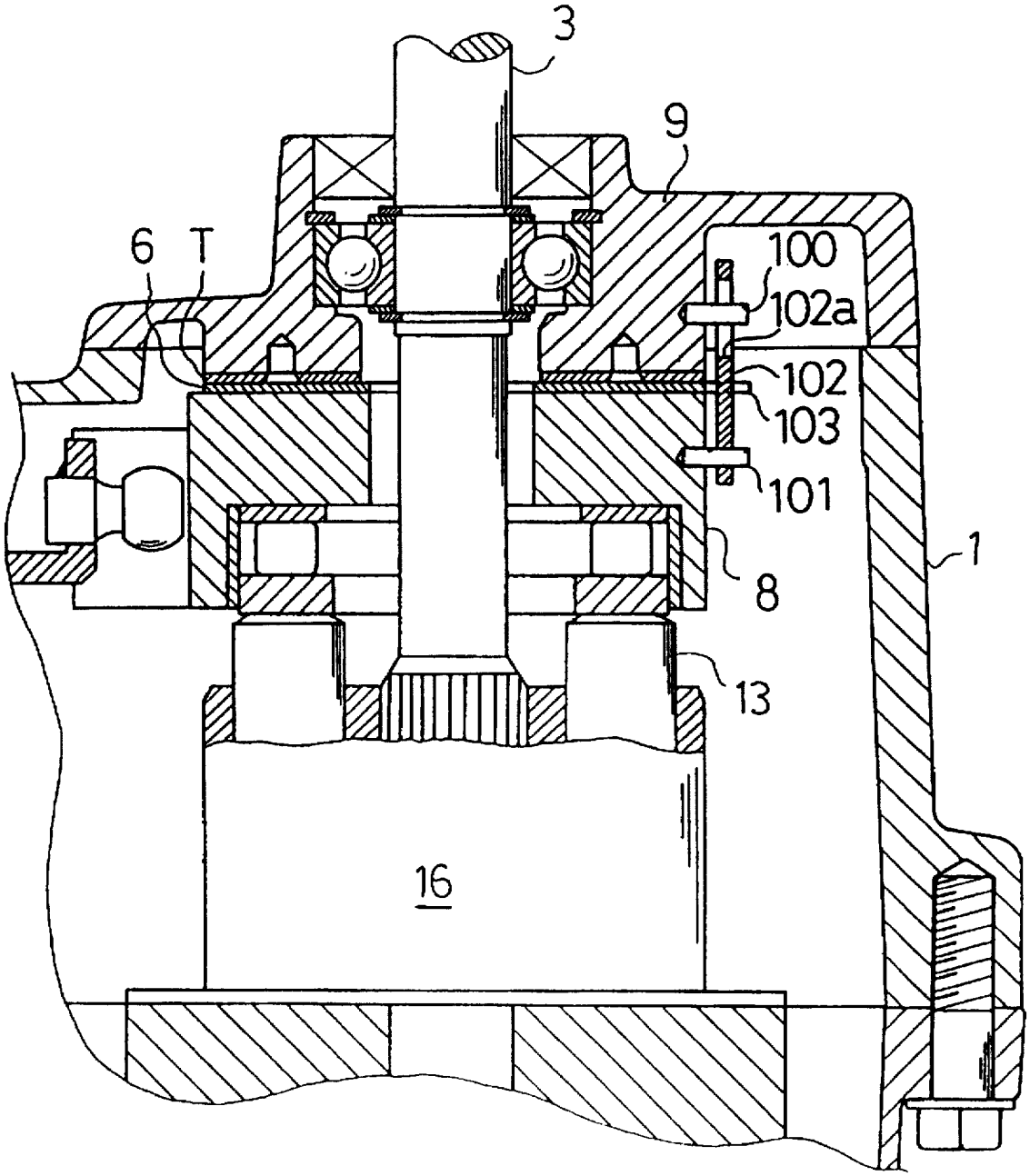
FIG. 18 is a cross sectional side view of still another modified embodiment, in which plate 6 is associated with the slantwise rotation of swash plate 8.
Figure 19:
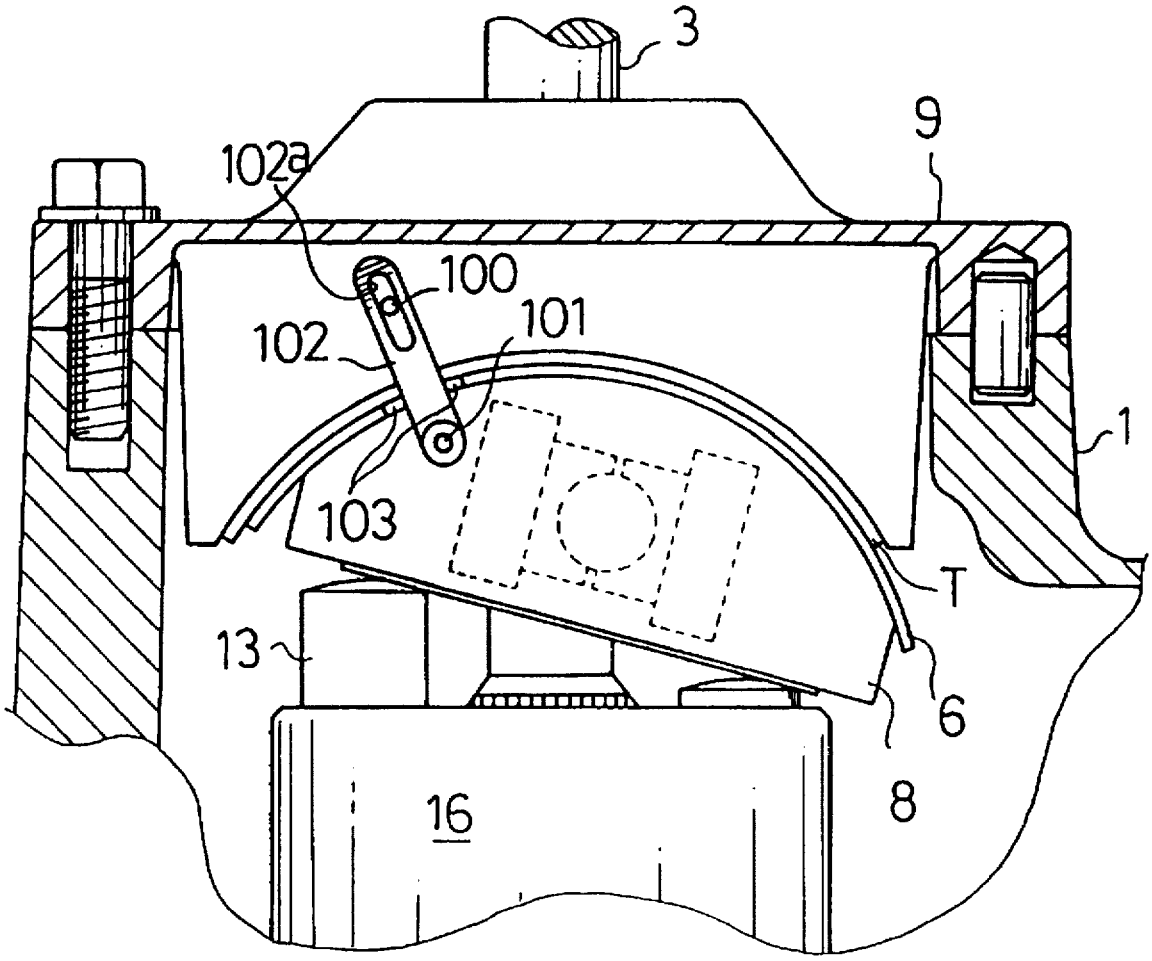
FIG. 19 is a front view of the same.

Arcuate plate 6 may be fixed to swash plate 8 so as to rotate slantwise together therewith. As described below, arcuate plate 6 may be shifted only to a moderate extent in the same direction when swash plate 8 is rotated slantwise. In this case, the operating force for slantwise rotation of the swash plate 8 can be reduced. This is disclosed in FIGS. 18, 19, and 20.

In these embodiments, a first pivot pin 100 is provided at the side surface of support member 9 and a second pivot pin 101 is provided at the side surface of swash plate 8. Both pins 100 and 101 are connected to each other by a link 102, an engaging portion 103 of arcuate plate 6 is inserted at the intermediate portion thereof. A portion of link 102 connected with first pivot pin 100 is formed in a slot 102*a*, constituting a lost motion mechanism for specifying displacement of arcuate plate 6. Slot 102*a* may be formed at a side of second pivot pin 101.

Figure 20:
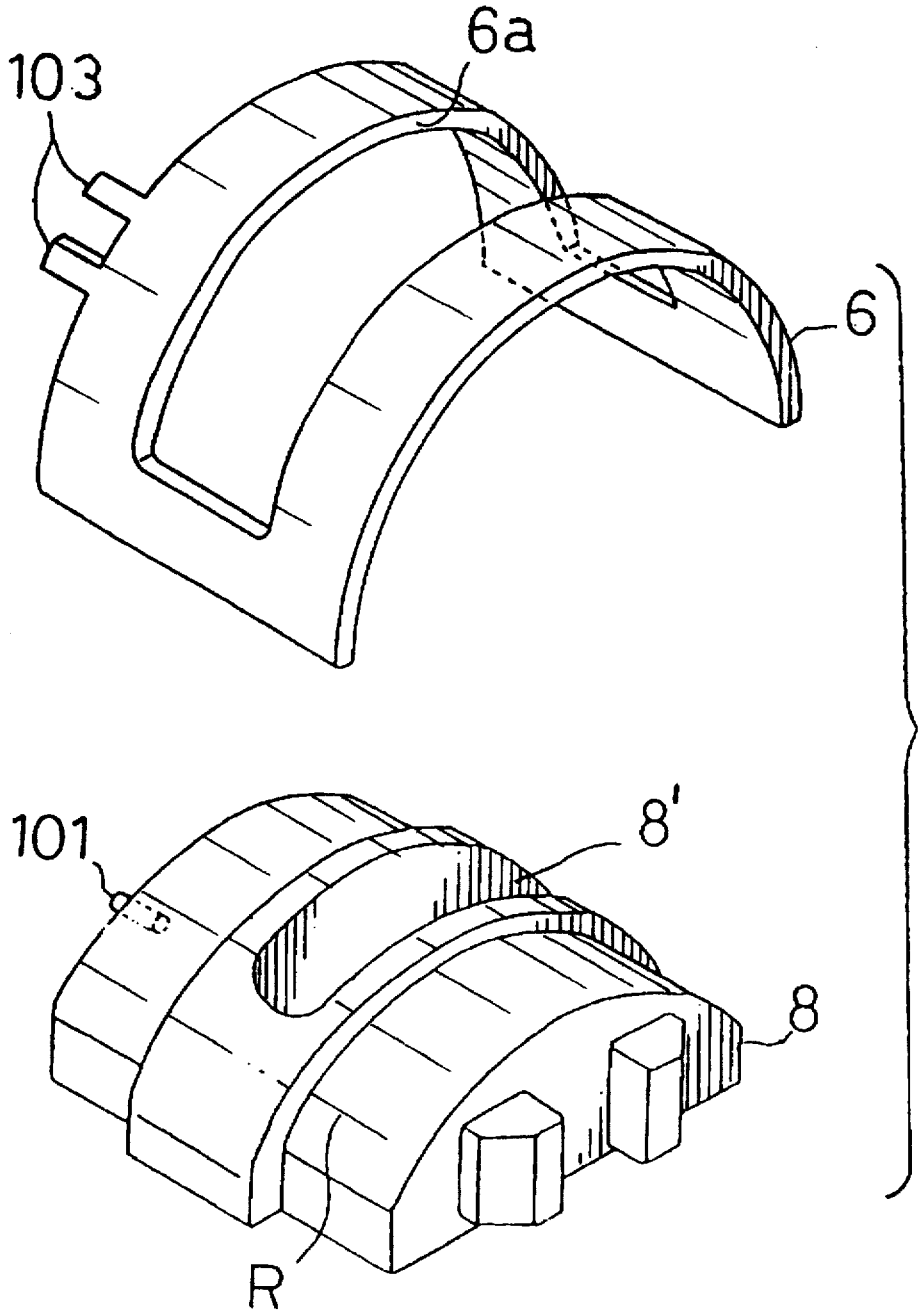
FIG. 20 is a perspective view showing a further embodiment of plate 6 and swash plate 8.

Arcuate plate 6, as shown in FIG. 20, is similar to that shown in FIG. 16 in that it is formed from a flat steel sheet which is square when viewed from above and is provided with an opening 6*a* through which pump shaft 3 extends. Plate 6 is curved in an arc to coincide with curved portion R of swash plate 8.

The movement of swash plate 8 when it is rotated slantwise is transmitted to arcuate plate 6 through link 102 and engaging portion 103 so that arcuate plate 6 is shifted by slot 102*a* in a ratio of about half of the slantwise rotation of swash plate 8. When swash plate 8 returns to the neutral position, arcuate plate 6 is restored to its original position.

The preferred embodiment was chosen and described in order to best explain the principles of the present invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A variable displacement hydraulic system comprising:

a housing;

an arcuate contact surface provided at an inner surface of said housing;

a thrust metal mounted to said arcuate contact surface of said housing;

a cylinder block having a rotary axis provided with a plurality of pistons movable in reciprocation and contained in said housing;

a swash plate having a central opening and provided at both sides thereof with outwardly curved portions, said outwardly curved portions of said swash plate moving along said arcuate contact surface to thereby control the reciprocation of said pistons;

a rotary shaft connected to said cylinder block and extending through said opening of said swash plate to extend along said rotary axis; and an arcuate plate which is provided on said outwardly curved portions of said swash plate and is formed of a material having a smooth surface and high sliding efficiency, whereby said arcuate plate slidably contacts said thrust metal.

2. A variable displacement hydraulic system as set forth in claim 1, further comprising:

means for coupling said arcuate member and said outwardly curved portions of said swash plate, said coupling means maintaining said arcuate member together with said swash plate when said swash plate is rotated slantwise.

3. A variable displacement hydraulic system as set forth in claim 2, wherein said coupling means comprises:

a recess provided in each of said outwardly curved portions of said swash plate; and a projection provided in said arcuate member for mating with said recess.

4. A variable displacement system as set forth in claim 2, wherein said coupling means comprises:

a projection provided on each of said outwardly curved portions of said swash plate; and a recess provided in said arcuate member for mating with said projection.

5. A variable displacement hydraulic system as set forth in claim 1, further comprising:

means for coupling said arcuate member to said swash plate, and wherein said arcuate member has a longer peripheral length than said outwardly curved portions of said swash plate, whereby when said swash plate is rotated slantwise, said arcuate member always remains in surface contact with said slidable contact surface.

6. A variable displacement hydraulic system as set forth in claim 1, wherein said arcuate member comprises:

a pair of arcuate plates, wherein one of said pair is disposed at each side of said central opening.

7. A variable displacement hydraulic system as set forth in claim 1, wherein said arcuate member comprises a pair of arcuate plates connected to each other, forming a single piece defining an opening through which said rotary shaft extends, and said arcuate plates overlap said outwardly curved portions of said swash plate on either side of said opening.

8. A variable displacement hydraulic system comprising:

a housing;

an arcuate slidable contact surface provided at an inner surface of said housing;

a cylinder block having a rotary axis provided with a plurality of pistons movable in reciprocation and contained in said housing;

a swash plate having a central opening and provided at both sides thereof with outwardly curved portions, said outwardly curved portions of said swash plate moving along said slidable contact surface to thereby control the reciprocation of each of said pistons;

a rotary shaft connected to said cylinder block and perforating through said opening of said swash plate to extend along said rotary axis;

an arcuate plate overlaps said outwardly curved portions of said swash plate and is formed of a material having a smooth surface and a high sliding efficiency; and means for shifting said arcuate plate in response to a slantwise rotation of said swash plate.

9. A variable displacement hydraulic system as set forth in claim 8, wherein the surface of said outwardly curved portions of said swash plate is smooth and has a high sliding efficiency.

10. A variable displacement hydraulic system as set forth in claim 8, wherein said means for shifting said arcuate plate gives about half displacement of slantwise rotation of said swash plate with respect to said arcuate plate.

11. A variable displacement hydraulic system as set forth in claim 8, wherein said means for shifting said arcuate plate comprises:

a first pivot point provided on the inner surface of said housing;

a second pivot point provided on said swash plate;

link means for connecting said first and second pivot points with each other;

lost motion means included between at least one of said first and second pivot points and said link means; and an engaging portion provided at said arcuate plate for engaging with said link means.

12. A variable displacement hydraulic system as set forth in claim 8, wherein said arcuate plate comprises a pair of arcuate plates connected to each other, forming a single piece defining an opening through which said rotary shaft extends, and said arcuate plates overlap said outwardly curved portions of said swash plate on either side of said opening.

13. A variable displacement hydraulic system comprising:

a housing;

an arcuate slidable contact surface provided at an inner surface of said housing;

a cylinder block having a rotary axis provided with a plurality of pistons movable in reciprocation and contained in said housing;

a swash plate having a central opening and provided at both sides thereof with outwardly curved portions, said outwardly curved portions of said swash plate moving along said slidable contact surface to thereby control the reciprocation of said pistons;

a rotary shaft connected to said cylinder block and extending through said opening of said swash plate to extend along said rotary axis;

an arcuate plate which overlaps said outwardly curved portions of said swash plate formed of a material having a smooth surface and high sliding efficiency; and bent portions provided at said arcuate plate which fit said outwardly curved portions of said swash plate for maintaining said arcuate plate together with said swash plate when said swash plate is rotated slantwise.

14. A variable displacement hydraulic system comprising:

a housing;

an arcuate slidable contact surface provided at an inner surface of said housing;

a cylinder block having a rotary axis provided with a plurality of pistons movable in reciprocation and contained in said housing;

a swash plate having a central opening and provided at both sides thereof with outwardly curved portions, said outwardly curved portions of said swash plate moving along said slidable contact surface to thereby control the reciprocation of said pistons;

a rotary shaft connected to said cylinder block and extending through said opening of said swash plate to extend along said rotary axis; and an arcuate plate which overlaps said outwardly curved portions of said swash plate formed of a material having a smooth surface and high sliding efficiency, said arcuate plate being cast on the surface of said outwardly curved portions of said swash plate when said swash plate is molded.

* * * * *

UNITED STATES PATENT AND TRADEMARK OFFICE

CERTIFICATE OF CORRECTION

PATENT NO. : 5,709,141

DATED : January 20, 1998

INVENTOR(S) : Ohashi *et al.*

It is certified that error appears in the above-indentified patent and that said Letters Patent is hereby corrected as shown below:

In column 9, line 49, change "plate" to --member--, line 52, change "plate" to --member--.

Signed and Sealed this

Seventh Day of July, 1998

Bruce Lehman

*Attest:*

BRUCE LEHMAN

*Attesting Officer*

*Commissioner of Patents and Trademarks*